US007632222B1

(12) United States Patent
Crognale

(10) Patent No.: US 7,632,222 B1
(45) Date of Patent: Dec. 15, 2009

(54) THERAPEUTIC STRETCH TABLE

(76) Inventor: Daniel Crognale, 59 Boulevard East, Cliffwood Beach, NJ (US) 07736

( * ) Notice: Subject to any disclaimer, the term of this patent is extended or adjusted under 35 U.S.C. 154(b) by 0 days.

(21) Appl. No.: 12/287,408

(22) Filed: Oct. 10, 2008

(51) Int. Cl.
*A63B 26/00* (2006.01)

(52) U.S. Cl. ..... 482/142; 601/5; 601/1; 128/845

(58) Field of Classification Search ..... 482/142, 482/907, 148; 601/1; 128/845–846; 606/1; 5/600–624; D21/676, 686, 690
See application file for complete search history.

(56) References Cited

U.S. PATENT DOCUMENTS 5,354,251 A * 10/1994 Sleamaker ..... 482/96
6,595,586 B2 * 7/2003 Brightbill et al. ..... 297/312

* cited by examiner

*Primary Examiner*—Lori Baker
(74) *Attorney, Agent, or Firm*—Charles I. Brodsky

(57) ABSTRACT

A table separable lengthwise into two sections by a supine or prone user through a flexing of the legs and a pulling on hand supports to stretch tension springs beneath the table a controllable degree and for a controllable time.

14 Claims, 6 Drawing Sheets

THERAPEUTIC STRETCH TABLE

CROSS-REFERENCE TO RELATED APPLICATIONS

None

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not applicable

BACKGROUND OF THE INVENTION

1. Field of the Invention

This invention relates to therapeutic stretch tables, in general, and to an alternative to the use of inversion therapy for relieving pressure on the discs and nerve roots of the spine, in particular.

2. Description of the Related Art

As will be appreciated, with the advent of medical understanding and technical development, computer programmed tables have been developed to assist the health professional in conducting examinations, adjustments and treatments beneficial to a patient complaining of back pain. Many chiropractic groups and rehabilitation therapy centers do not possess such tables, however, primarily because of their significantly high costs. Those that have acquired them, on the other hand, amortize the costs involved by having a patient sign up for a lengthy course of treatment which for many (especially those on fixed income), cannot be economically dealt with.

As will also be appreciated, "inversion therapy" has recently been promoted as an alternative therapy for back pain treatment. There, traction resulting from hanging upside down (supported by the ankles), is presented to allow gravity to naturally decompress discs and nerve roots. Hanging by the feet, as with gravity boots, is said to cause each joint in the body to be loaded in an equal and opposite manner to standing in an identical position of joint alignment. By holding the bones of the spine and legs together when hanging upside down, the pressure exerted on the nerves is said to be removed, in allowing the discs to recover lost moisture and to return to their original shape. (The space between the spinal discs is said to be increased as well.) With yet another alternative form of inversion therapy, entailing lying on a table that gradually tips the head down (again while being supported by the ankles), a gradual introduction and increase (of intensity and duration) of traction is said to cause stimulation for the strength of the ligaments to increase.

Acknowledging that inversion stimulates circulation differences due to gravity acting on the circulatory system in an opposite manner—opposing what gravity would normally assist, and assisting what it would normally oppose while upright—and that inversion devices are helpful in gaining flexibility due to the increased spacing in the joints due to traction—, there still have been noted to be health risks involved. Consultations with doctors have first been advised before starting the inversion therapy—and then progressing very slowly, starting at very light levels of inversion to begin with. In any event, assistance has also been recommended to get in and out of the apparatus, more so if health problems are experienced.

While all this may be said and done, it is still fairly obvious that Senior Citizens, most women, and out-of-shape men, simply do not relish the idea of hanging upside down to decompress the joints of the body below the anchoring ankles.

OBJECTS OF THE INVENTION

It is an object of the present invention, therefore, to provide a new and improved apparatus to provide traction and stretching for relief of back pain in a manner which obviates the problems associated with inversion therapy.

It is another object of the invention to provide such apparatus which can be purchased for home use at an easily affordable cost.

It is an object of the present invention, also, to provide this apparatus for use in a way that requires little, if any assistance in carrying out its function, and which requires a minimum amount of training for utilization, by essentially introducing nothing new to the user, and nothing which the user cannot easily comprehend.

It is yet a further object of the invention to provide this apparatus in a manner that would be acceptable for use by women and men alike, independent of their age and independent of whatever physical condition that they may then be in.

It is yet another object of the invention to provide such apparatus which, to operate, is solely under the control of the user, who can readily stop the traction and stretching easily, whenever he/she may wish to do so.

SUMMARY OF THE INVENTION

As will become clear from the following description, the present invention comprises a stretch table separable lengthwise into two sections, with foldable legs, and with first and second supports extending upwardly at one end of the tabletop for the feet to rest against. Third and fourth upwardly extending supports are removably insertable along opposite sides of the tabletop for bearing against the armpits of the user to adjust for users of different heights. Adjustable detents extend on the sides of the tabletop at spaced intervals, to set the spacing between the two sections when separated, reflective of the extent of traction desired. Velcro straps extend from the side or from underneath the tabletop to cross over the chest area of a supine lying user to secure him/her in place, while similar Velcro straps hold the feet in position at their supports. Hand supports extend upwardly from the tabletop in grooved slots to be grasped in separating the two sections to a "stretch" condition, and to then later release them to their initial quiescent state.

The amount of tension imparted in separating the hip area from the legs and the hip area from the shoulders is controlled by stretchable spring configurations at the underside of the tabletop sections. A flap or shelf underneath the tabletop supports that area of the body which would otherwise be suspended between the sections when separated.

In accordance with a preferred embodiment of the invention, the two tabletop sections and the stretchable spring configurations are manufactured and shipped as separate components for initial installation before use. This simplifies the manufacture and resultant shipment of the stretch table for purchase.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figures 1, 1A:
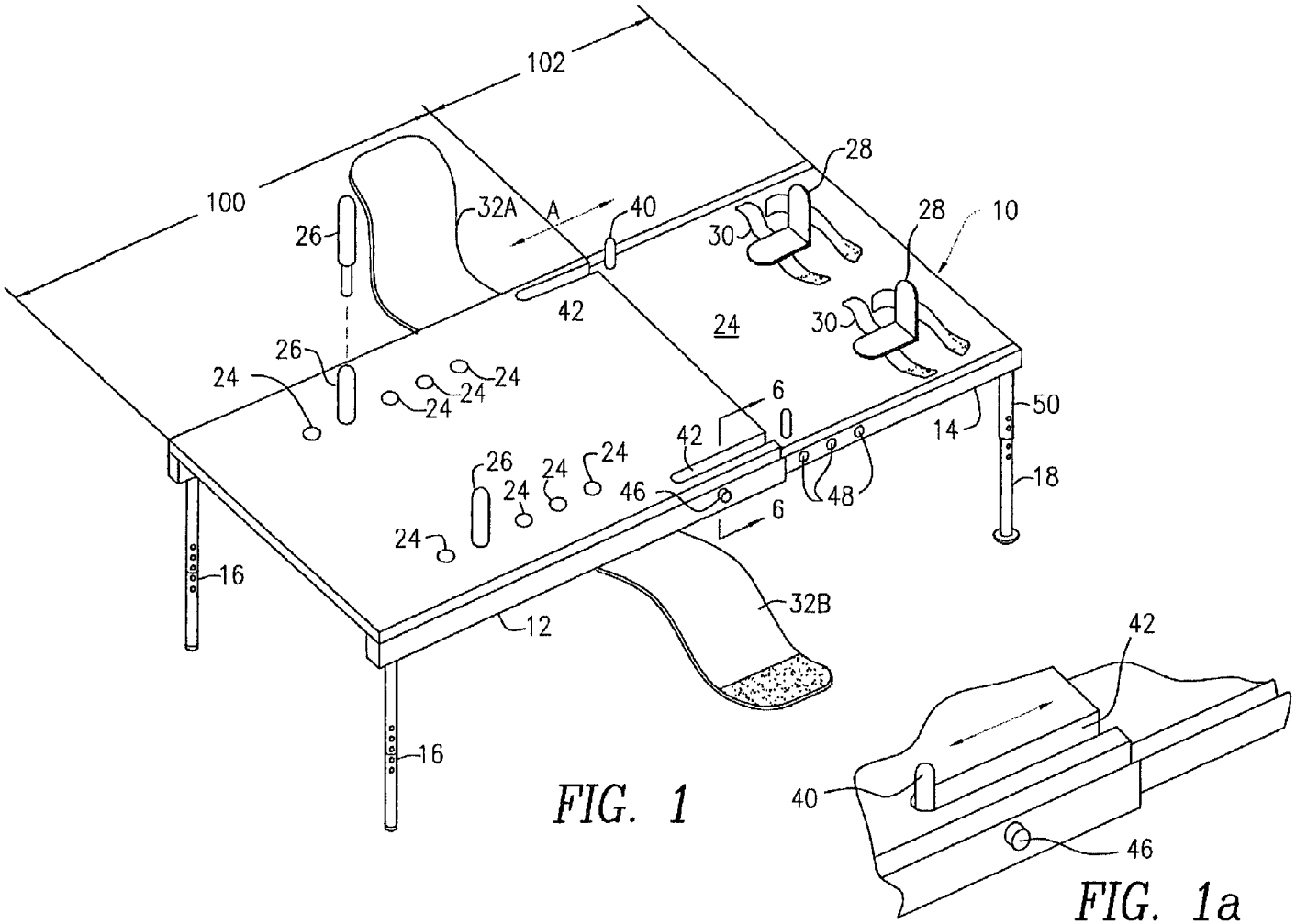
FIGS. 1, 1*a*, 2 and 3 are helpful in an understanding of the construction and operation of the therapeutic stretch table of the invention.
Figure 3:
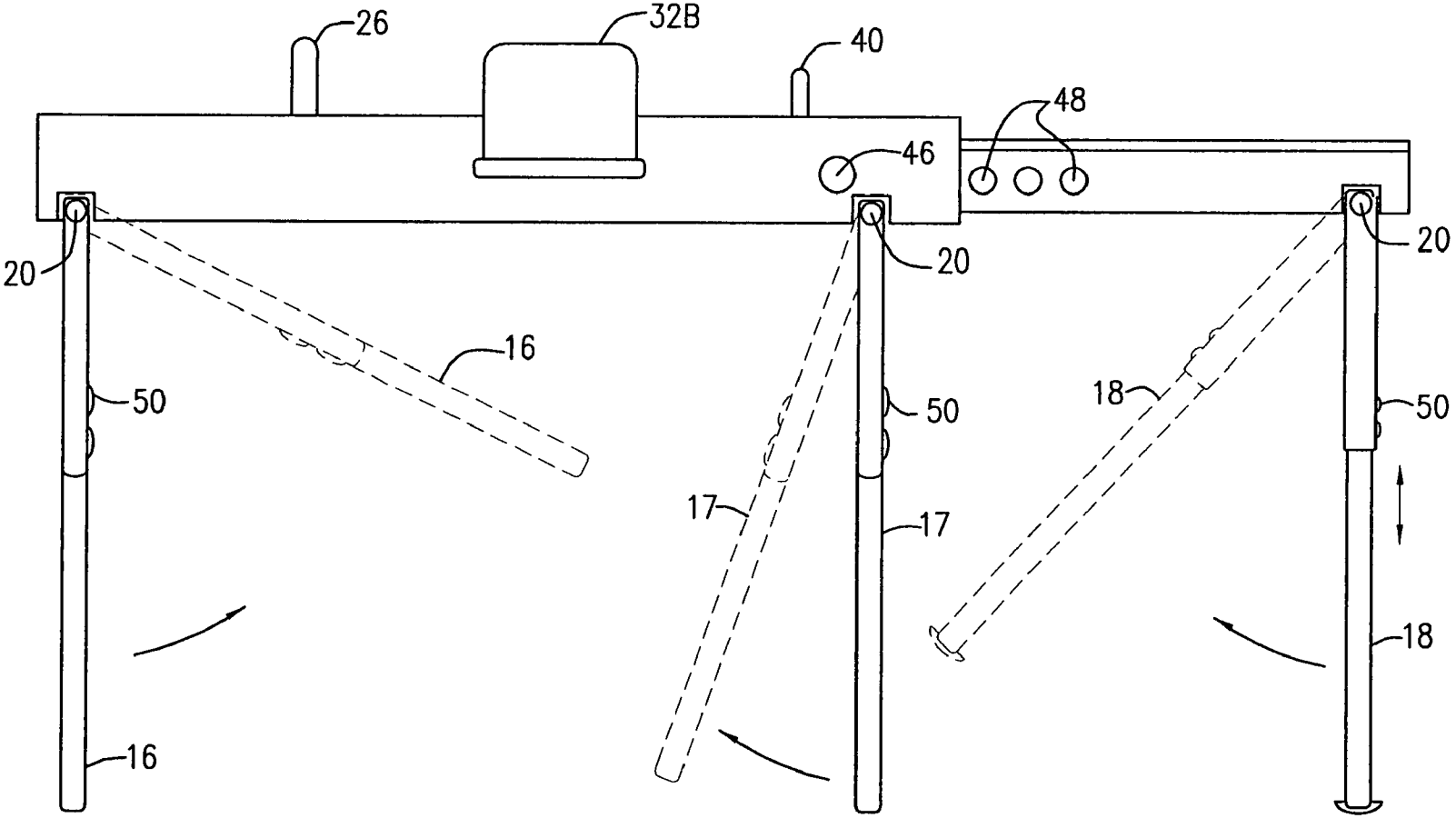
Figure 4:
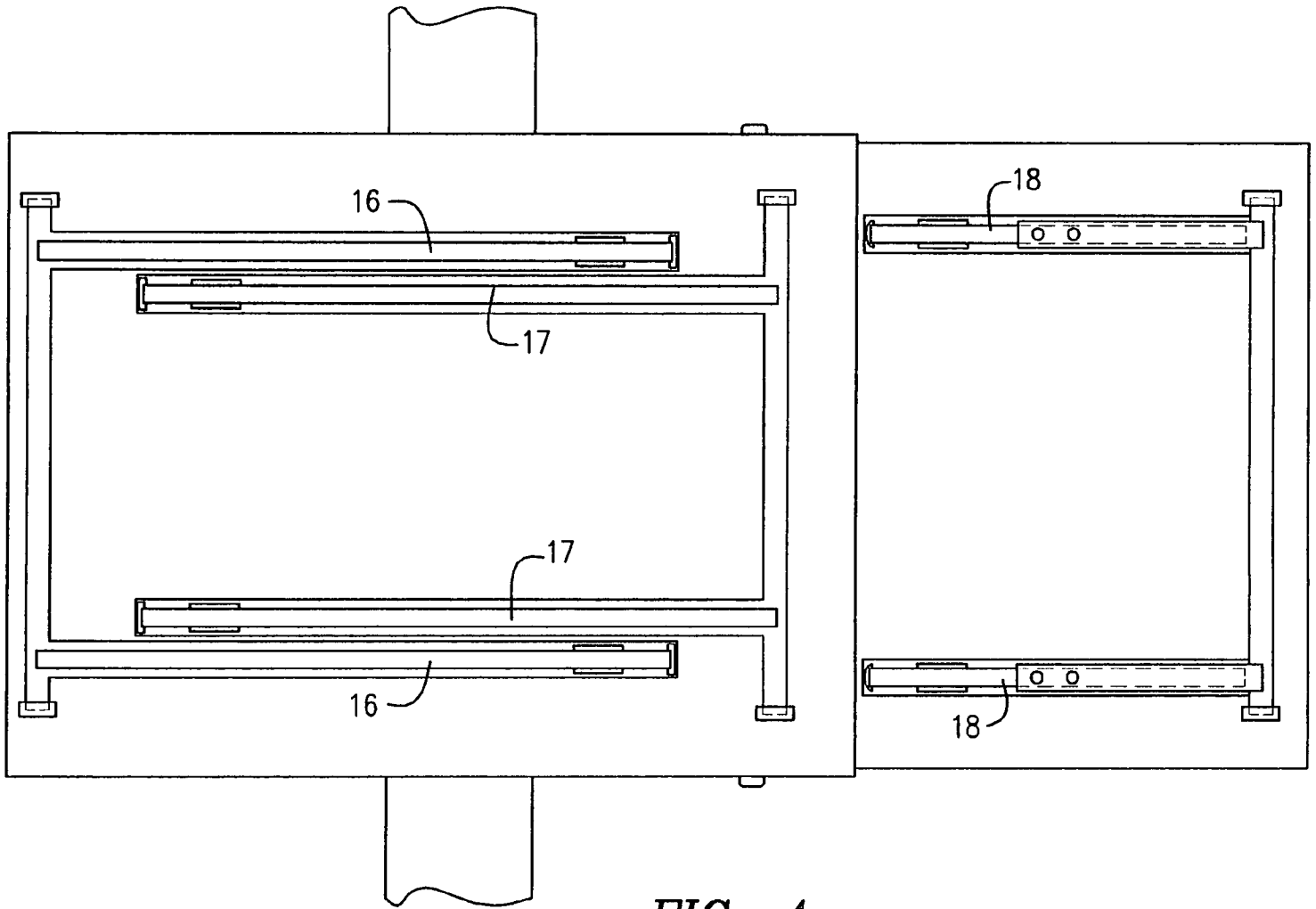
FIG. 4 illustrates the underside of the stretch table with the legs folded closed and the stretchable spring removed.

The stretch table 10 of FIG. 1, when assembled, consists of two separable sections 12, 14 and three pairs of foldable legs 16, 17, 18. Understanding that the middle pair of legs 17 are deployed only when the stretch table is being used (FIG. 3), the legs 17 are shown folded up underneath in FIG. 1 for ease of understanding. As is conventional, the pairs of legs are each foldable to fixed and release positions by means of appropriate hinge and/or pivot couplings 20.

FIG. 1 illustrates the table section 12 being of longer length 100 than the length 102 of the table section 14. FIG. 1 also illustrates the table section 12 as including a tabletop surface 22 provided with, for example, five apertures 24 laterally spaced along each side of the section, at 3 inch intervals for example. Into corresponding ones of these apertures, a movable, upwardly extending rod support 26 is insertable as shown.

The second table section 14, on the other hand, includes a tabletop surface 24 having a pair of upwardly extending supports 28, each with its own Velcro strap hook and loop fastener securement 30. As will be appreciated, it is against these supports 28 that, when lying supine on the table, a user's feet are rested, with the hook and loop Velcro fastener straps 30 then being securable to hold each foot in position. In use, a person lies on the tabletop surfaces 22, 24 with the feet against the rest supports 28, and with the rod supports 26 positioned at the user's armpits. Reference numerals 32A and 32B identify a further Velcro type hook and loop fastener securement to be adjustably positioned across the chest of the user of the stretch table apparatus. The hook and loop fastener straps 30 thus serve as a means far securing the feet of a user against the upwardly extending rest supports 28, while the hook and loop fastener straps 32A and 32B serve as a means for securing the user supine against the tabletop surfaces 22, 24.

Means are also provided on the tabletop surface for a user to control in setting the amount of stretch desired. In particular, to accomplish the stretch table movement openable to the left, and then closable to the right as in FIG. 1, a pair of fixed handles 40 are provided, one on the left side of the tabletop surface 24 and one on the right side. Grooved slots 42 are cut lengthwise into the tabletop surface 22 to receive these upwardly extending handles 40 to move the two sections 12, 14 toward or away from one another. Push-button detents 46 on the side rails of the section 12 are securable to fit within one of a plurality of spaced orifices 48 along the side rails of the section 14 to set the extent of table section separation. For the least lengthwise separation of the sections 12, 14, the push-button detents 46 are set within the right-most orifices 48 at the section 14 rail (FIG. 1*a*),—while for greatest separation, the push-button detents 46 are set in the left-most orifices. The height of the stretch table section above the floor can be set, if desired, through a similar use of push-button detents and apertures on the legs 16, 17 and 18—as at 50.

Figure 2:
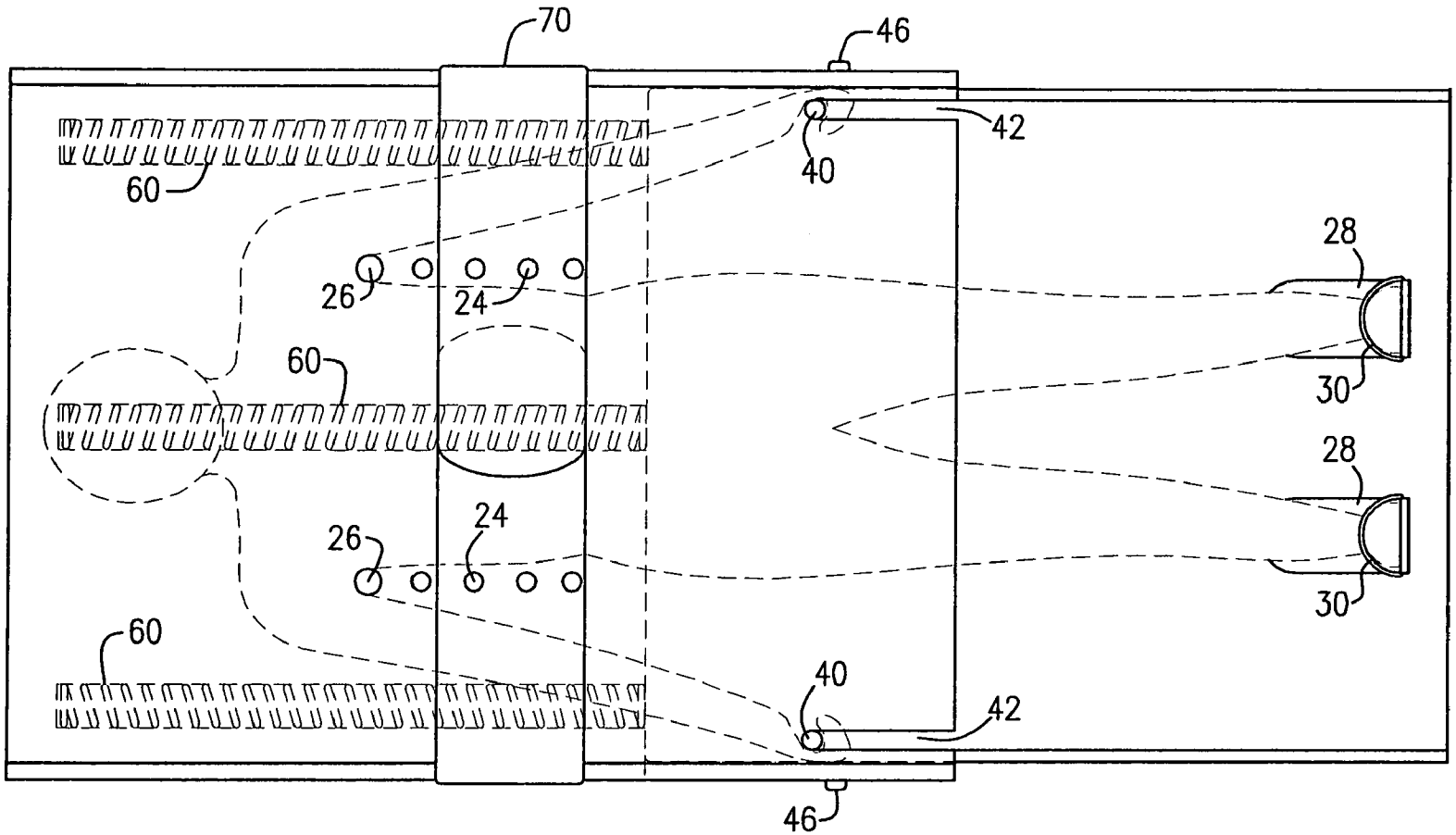

As will be appreciated, in use, the user lies supine on the tabletop surfaces 22, 24 (in the manner illustrated by the view of FIG. 2, looking upward from beneath and through the stretch table 10). The feet are strapped against the supports 28, and the movable rod supports 26 are positioned according to the height of the user, at his/her armpit locations. The user grasps onto each handle 40.

As will become apparent from the following two paragraphs, these components of FIGS. 1, 1*a* and 2 serve as a means, when the user is supine, for controlling the extent of separation between the sections 12 and 14—specifically, by setting the tension on the springs 60. As will be understood, the rest supports 28 support the feet of the supine user, the movable rod supports 26 are positioned to align with the armpit locations of the user, and the hook and loop fastener 32*a* and 32*b* secure the back of the supine user against the tabletop when the hook and loop fastener is adjustably positioned across the user's chest.

To commence the desired stretching, the user first sets the push-button detents 46 in the selected orifices 48. After strapping in, the user then flexes the legs against the foot rests 28 and pulls on the handles 40 in their grooved slots 42 to slide the two tabletop sections 22, 24 apart. The flexing continues until the detent-set position is reached, and then held there, for as long a time as the resulting stretch and traction is desired. Three springs 60 located on the underside of the tabletop 22 stretch outwardly as the separation is accomplished, and provide the tension stretch. When the period of the stretching is to be concluded, the pulling on the handles 40 in the slots 42 is released, the tension of the springs is withdrawn, the handles return, and the two tabletop sections 22, 24 slide back to their original positions. Obviously, one, two or more springs may be utilized, as well, depending on the degree of resistance desired.

Figure 5:
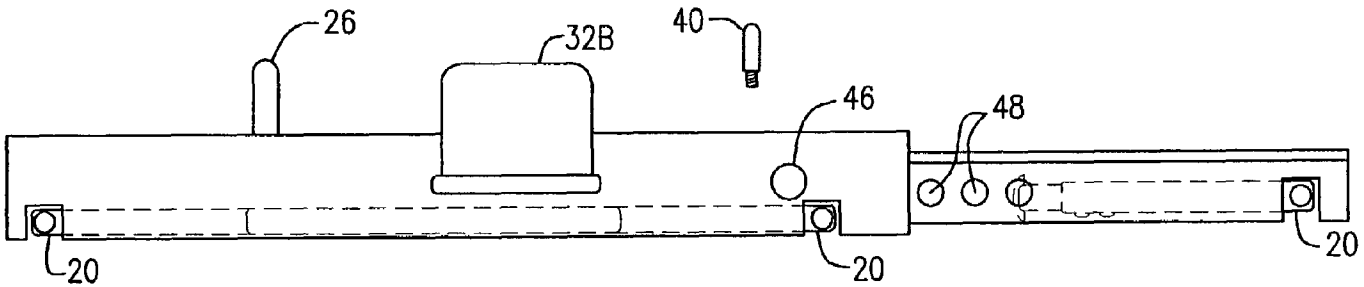
FIG. 5 is a side view of the tabletop helpful in an understanding as to how the separation of the two table sections is controlled.
Figure 6:
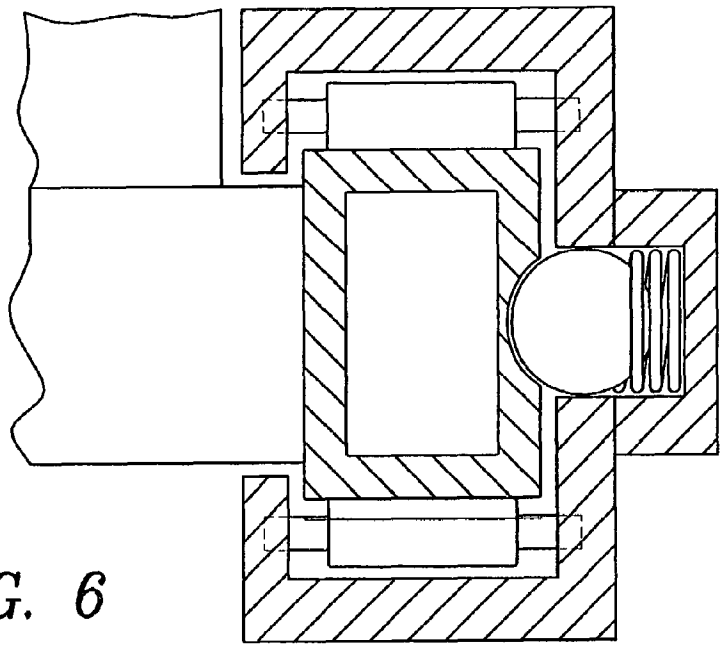
FIG. 6 is a partial sectional view showing how the body of a user is supported once the two table sections are separated.
Figure 7:
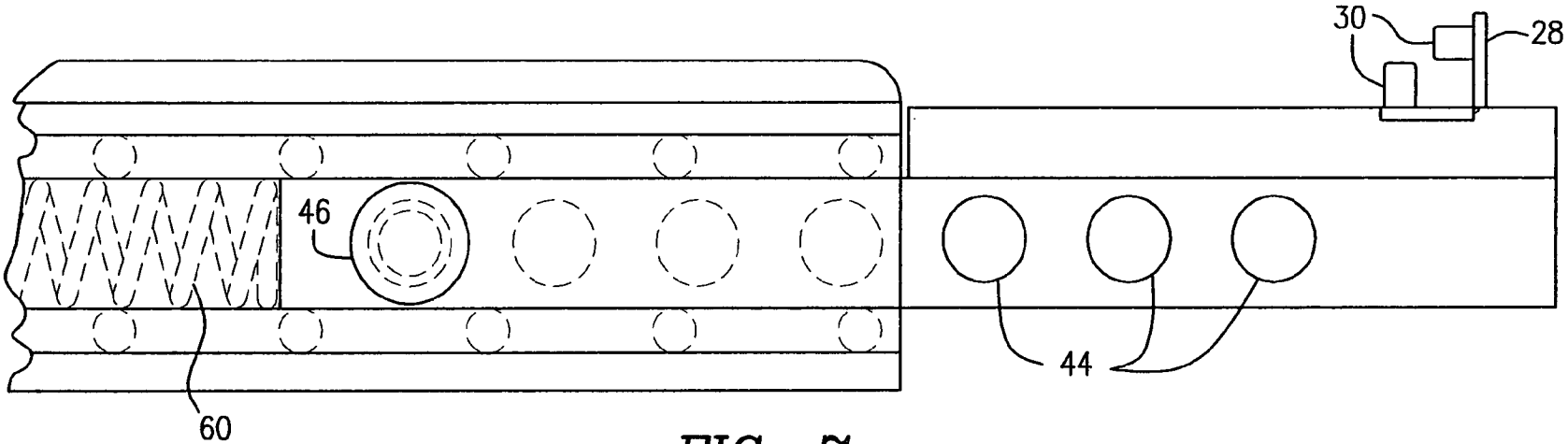
FIGS. 7 and 8 respectively show side and end views of the stretch table of the invention.
Figure 8:
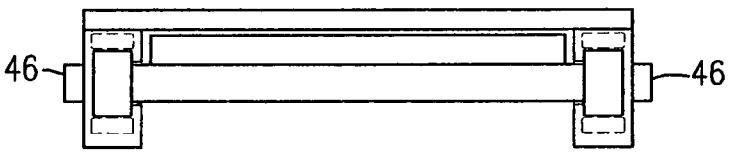
Figure 9:
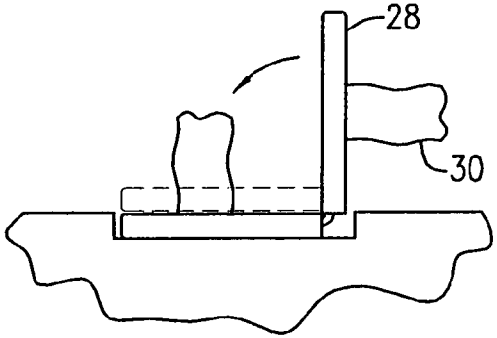
FIG. 9 illustrates the foldable nature of the foot support for ease of collapse in the shipment of the stretch table and in its storage when not being used.

As will be understood, the extent of tension imparted depends upon which of the orifices 48 the push-button detents 46 are inserted into and how far into the grooved slots 42 the handles 40 are pulled. FIG. 5, in this respect, shows the variations of the orifice and handle positions as well as the adjustability of the movable rod supports 26 for setting against the armpit locations. FIG. 2 illustrates a flap or shelf 70 at the underside of the stretch table 10 to support the back area of the user as the two table sections 12, 14 are separated.

Several advantages will be seen to follow from the preferred embodiment. First, the extent of possible tension during the stretching is under the control of the user, simply by a positionings/repositioning of the detent buttons 46 in the orifices 48. Secondly, the movement of the handles 40 within the grooved slots 42 allows a measure of further control and positioning for the detents. Thirdly, an understanding of how the stretch table is to be used easily follows, as all that is necessary is to set the push-button detents, lock the feet in position, set the rod supports 26 to the armpits, secure the Velcro strap across the chest and grasp onto the handles 40. No assistant to aide in the process is required, as the user will be seen to be capable of carrying out all the steps alone, for as long as he/she desires. Fourthly, folding and unfolding the legs 16, 17 and 18 is no more different than opening or closing of a bridge table, and the leg adjustments for the height of the table from the floor is also easily settable. For manufacture and shipping, the two tabletop sections 12, 14 can be produced separately and then readily installable one with the other when removed from the package used for shipment at the user's home or apartment location. Hanging upside down is not at all required—and the overall operation greatly simulates the mere lying down on a bed whose mattress might be visualized as having upwardly extending rod supports to be grasped in simulation of extending one's legs lengthwise.

While there has been described what is considered to be a preferred embodiment of the present invention, it will be readily appreciated by those skilled in the art that modifications can be made without departing from the scope of the teachings herewith. For example, whereas the invention has been described in the context of a user's setting a desired push-button detent insertion before lying in a face-up supine position on the stretch table, the invention's stretching action would operate equally as well for a user lying in a prone face-down position (although without the deployment of the foot or chest securements). Similarly, the stretching operation would continue exactly the same in the event of the user changing one detent position to another while lying on the stretch table to begin with. In all these situations, the detent position defines the maximum amount of stretch and traction possible, while the extent of the user pulling on the handles in the described grooved slots determines the actual tension applied for that setting at any given instant of time. For at least such reason, therefore, resort should be had to the claims appended hereto for a true understanding of the scope of the invention.

I claim:

1. A therapeutic stretch table comprising:

a tabletop on which a user is to lie, including a pair of lengthwise separable tabletop sections;

support legs extending downwardly from undersides of said pair of sections;

at least one tension spring securable between said pair of sections and stretchable as said sections are separated; and means for controlling the amount of stretch of said tension spring and determining the extent of separation between said pair of sections;

with said means including upwardly extending rests on a first of said sections for supporting the feet of a user lying on said tabletop, pairs of apertures extending linearly along a second of said sections, and a pair of upwardly extending removable supports, each of which is insertable into individual ones of said pairs of apertures to align with the armpit locations of the user.

2. The therapeutic stretch table of claim 1, additionally including means on said first section for securing the feet of a supine user against said upwardly extending rests.

3. The therapeutic stretch table of claim 2 wherein said means for securing the feet of a supine user includes one pair of hook and loop fastener securements for each foot.

4. The therapeutic stretch table of claim 3, also including means on said second section for securing the back of a supine user against said tabletop.

5. The therapeutic stretch table of claim 4 wherein said means for securing the back of a supine user includes a hook and loop fastener securement overlying the chest of the user.

6. The therapeutic stretch table of claim 4, including pairs of orifices extending linearly along opposing side rails of said first section, and a pair of push-button detents on opposing side rails of said second section to fit within selected ones of said orifices for setting the maximum amount of linear separation between said pair of tabletop sections.

7. The therapeutic stretch table of claim 6, additionally including a pair of grooved slots within said second section and a pair of upwardly extending hand supports on said first section movable within said slots when grasped by a user lying on said tabletop.

8. The therapeutic stretch table of claim 7 wherein two pairs of said support legs extend downwardly from an underside of said second section, and wherein one pair of support legs extend downwardly from an underside of said first section.

9. The therapeutic stretch table of claim 8 wherein said pairs of support legs are each adjustable in length.

10. The therapeutic stretch table of claim 7, including three spaced tension springs, each of which is securable between said first and second sections and stretchable as said sections are separated.

11. A therapeutic stretch table comprising:

a tabletop including a pair of lengthwise separable tabletop sections;

a first pair of support legs extending downwardly from an underside of a first of said pair of sections and two pairs of support legs extending downwardly from an underside of the second of said pair of sections;

three spaced tension springs securable between said first and second sections and stretchable as said sections are separated;

a pair of upwardly extending rests on said first section for supporting the feet of a user lying on said tabletop;

first and second pairs of spaced apertures extending linearly along a top side of said second section;

a pair of upwardly extending supports, individual ones of which are insertable into individual ones of said pair of apertures;

first and second pairs of spaced orifices extending linearly along opposing side rails of said first section;

first and second detents on opposing side rails of said second section to fit within selected orifices on said first section;

a pair of grooved slots through a top surface of said second section; and a pair of upwardly extending hand supports on said first section for grasping by said user, and individually movable lengthwise within one of said pair of grooved slots.

12. The therapeutic stretch table of claim 11, also including a flap extending between said first and second sections when separated to support the body of said user.

13. The therapeutic stretch table of claim 11, also including first and second pairs of strap securements upwardly extending from said first section about said supporting foot rests.

14. The therapeutic stretch table of claim 13, additionally including a strap securement upwardly extending from said second section.

* * * * *